US009630218B2

(12) United States Patent
Kakutani et al.

(10) Patent No.: US 9,630,218 B2
(45) Date of Patent: Apr. 25, 2017

(54) AIR-FLUSHING METHOD, AIR-FLUSHING DEVICE, AND RECORDING MEDIUM

(71) Applicant: OMRON Corporation, Kyoto-shi, Kyoto (JP)

(72) Inventors: Akinobu Kakutani, Okayama (JP); Satoshi Shiroko, Nagano (JP); Haruyuki Fujitsuna, Nagano (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/762,746

(22) PCT Filed: Jan. 24, 2014

(86) PCT No.: PCT/JP2014/051567
§ 371 (c)(1),
(2) Date: Jul. 22, 2015

(87) PCT Pub. No.: WO2014/125907
PCT Pub. Date: Aug. 21, 2014

(65) Prior Publication Data

US 2015/0360263 A1 Dec. 17, 2015

(30) Foreign Application Priority Data

Feb. 12, 2013 (JP) ..... 2013-024912

(51) Int. Cl.
*B08B 7/04* (2006.01)
*B08B 5/02* (2006.01)
(Continued)

(52) U.S. Cl.
CPC ..... *B08B 5/02* (2013.01); *B05B 1/005* (2013.01); *B05B 12/06* (2013.01)

(58) Field of Classification Search
CPC ..... B08B 5/02; B08B 1/005; B08B 12/06; B08B 3/04
(Continued)

(56) References Cited

U.S. PATENT DOCUMENTS 4,923,374 A * 5/1990 Lundin ..... B01F 11/0071 122/379
5,876,281 A 3/1999 Hirasawa et al.
(Continued)

FOREIGN PATENT DOCUMENTS

CN 201632452 U 11/2010
EP 2428286 A2 3/2012
(Continued)

OTHER PUBLICATIONS

English translation of International Preliminary Report on Patentability and Written Opinion issued in corresponding International Application No. PCT/JP2014/051567 dated Aug. 27, 2015, (6 pages).
(Continued)

*Primary Examiner* — Duy Deo
*Assistant Examiner* — Maki Angadi
(74) *Attorney, Agent, or Firm* — Osha Liang LLP

(57) ABSTRACT

An air-flushing device cleans a cleaning object by air-blowing to the object from a nozzle. The air-flushing device outputs a pressure value changing according to electromagnetic valve's opening/closing, and controls the valve's opening/closing based on two reference values of an upper-limit setting value and a lower-limit setting value lower than that. The air-flushing device closes the valve if the pressure value changes from lower than the upper-limit setting value to that or higher, and opens the valve if the pressure value changes from higher than the lower-limit setting value to that or lower.

10 Claims, 7 Drawing Sheets

(51) Int. Cl.
*B05B 1/00* (2006.01)
*B05B 12/06* (2006.01)

(58) Field of Classification Search
USPC ..... 134/18, 129, 166, 175; 15/304, 316.1, 15/404
See application file for complete search history.

(56) References Cited

U.S. PATENT DOCUMENTS

| | | | | |
|---|---|---|---|---|
| 6,189,176 | B1 | 2/2001 | Ivey et al. | |
| 2003/0008189 | A1 | 1/2003 | Katagiri et al. | |
| 2005/0150526 | A1 | 7/2005 | Matsushita | |
| 2011/0255995 | A1* | 10/2011 | Field | F04B 49/022 417/53 |

FOREIGN PATENT DOCUMENTS

| | | | |
|---|---|---|---|
| JP | S62-194488 | U | 12/1987 |
| JP | H03-248948 | A | 11/1991 |
| JP | H05-301083 | A | 11/1993 |
| JP | H06-106148 | A | 4/1994 |
| JP | H10-52654 | A | 2/1998 |
| JP | 2003-017101 | A | 1/2003 |
| JP | 2005-185939 | A | 7/2005 |
| JP | 2005-211858 | A | 8/2005 |
| JP | 2007-069056 | A | 3/2007 |
| KR | 2004-0044180 | A | 5/2004 |
| KR | 10-0884726 | B1 | 2/2009 |
| WO | 03/020449 | A1 | 3/2003 |

OTHER PUBLICATIONS

International Search Report issued in PCT/JP2014/051567 mailed on Apr. 28, 2014 (2 pages).
Written Opinion of the International Searching Authority issued in PCT/JP2014/051567 mailed on Apr. 28, 2014 (3 pages).
Okazaki, M. et al.; "Effect of Pulsed Air Jet on the Air Jet Removal of Adhered Single Particles"; Journal of the Society of Powder Technology, Japan, vol. 45, 2008, pp. 297-304 (8 pages).
Office Action issued in corresponding Chinese Application No. 201480005946.5 dated Jan. 6, 2016, and English translation thereof (16 pages).
Office Action in counterpart Korean Patent Application No. 10-2015-7020071 issued on Nov. 28, 2016 (14 pages).

* cited by examiner

AIR-FLUSHING METHOD, AIR-FLUSHING DEVICE, AND RECORDING MEDIUM

CROSS-REFERENCE TO RELATED APPLICATIONS

This is a national stage application based on PCT/JP2014/051567, filed on Jan. 24, 2014, which claims priority to foreign application JP 2013-024912, filed on Feb. 12, 2013. The priority applications are hereby incorporated by reference in their entirety.

TECHNICAL FIELD

The present invention relates to an air-flushing method, an air-flushing device, a program and a storage medium each of which is for cleaning an object to be cleaned (hereinafter, referred to as "cleaning object") by blowing the air to the cleaning object.

BACKGROUND ART

There has been known a conventional air-flushing device for cleaning a cleaning object by blowing the air to the cleaning object. For example, Patent Literature 1 discloses an air-flushing device for air-flushing a cleaning object by causing a nozzle to blow clean air that is supplied from a clean air supply section, the air-flushing device including, in an air flow path between the clean air supply section and the nozzle, a valve which is made of an abrasion-resistant resin and opens and closes the air flow path.

The air-flushing device disclosed in Patent Literature 1 is able to open and close the valve with high frequency, thereby carrying out pulse blowing. For example, the valve is opened and closed 3 times to 10 times per second. This allows the inside of the valve to have an injection pressure indicated by a line graph of a serrated form having a vertex indicative of a maximum pressure P1. Thus, the air-flushing device carries out air-flushing with use of the maximum pressure P1 as a working pressure. As has been described, the conventional air-flushing device controls by time the frequency of opening and closing the valve.

CITATION LIST

Patent Literature

Patent Literature 1

Japanese Patent Application Publication, Tokukaihei, No. 5-301083 A (Publication Date: Nov. 16, 1993)

Patent Literature 2

Japanese Patent Application Publication, Tokukai, No. 2007-69056 A (Publication Date: Mar. 22, 2007)

Patent Literature 3

Japanese Patent Application Publication, Tokukai, No. 2005-185939 A (Publication Date: Jul. 14, 2005)

Patent Literature 4

Japanese Patent Application Publication, Tokukai, No. 2003-17101 A (Publication Date: Jun. 17, 2003)

Patent Literature 5

Japanese Patent Application Publication, Tokukaihei, No. 10-52654 A (Publication Date: Feb. 24, 1998)

Non Patent Literature

Non-Patent Literature 1

Mineya Okazaki et. al., "Kousoku Kiryuu niyoru Hyoumen Fuchaku Biryuushi no Jokyo nitaisuru Pulse Air no Kouka (Effect of Pulsed Air Jet on the Air Jet Removal of Adhered Single Particles)", Funtai Kougakukaishi (Journal of the Society of Powder Technology, Japan), p. 297 to 304, 2008.

SUMMARY OF INVENTION

Technical Problem

However, it is difficult to control opening and closing of the valve by time such that the maximum pressure is used as the working pressure regardless of the type of the nozzle. Specifically, a different type of nozzle has a different shape, a different flow path length, and a different flow rate. Therefore, the time required until the pressure inside the nozzle reaches the maximum pressure after the valve is opened varies depending on the type of valve. Thus, in order to use the maximum pressure as the working pressure, it is necessary to change the frequency of opening and closing of the valve according to the type of the nozzle.

Further, according to Non-Patent Literature 1, it is preferable that the air-flushing device should blow the air intermittently at as short intervals as possible in order to improve the removing efficiency. However, in order for the air-flushing device of Patent Literature 1 to carry out the air-blowing intermittently at shorter intervals with use of the maximum pressure, it is necessary to set the frequency of opening and closing of the valve in consideration of a period required until the pressure inside the nozzle becomes maximum after the valve is opened. For this purpose, it is necessary to repeatedly carry out a test operation of setting an optimum frequency of opening and closing the valve in accordance with the period required until the pressure inside the nozzle becomes maximum after the valve is opened. However, such an operation is inefficient.

The present invention has been made in view of the above problems, and it is an object of the present invention to provide an air-flushing method, an air-flushing device, a program, and a storage medium each of which is able to improve the removing efficiency effectively.

Solution to Problem

In order to attain the above object, an air-flush method of the present invention is an air-flushing method for cleaning a cleaning object by blowing the air to the cleaning object from a nozzle, said method including: a control step of controlling, in accordance with two reference values, opening and closing of a valve provided in a flow path through which the air goes to the nozzle, the two reference values including an upper-limit setting value and a lower-limit setting value which is lower than the upper-limit setting value; and an output step of outputting a physical quantity relating to the air, the physical quantity changing in accordance with opening and closing of the valve, in the control step, an OFF signal for closing the valve being outputted to the valve, in a case where the physical quantity outputted in the output step changes from a value lower than the upper-limit setting value to a value equal to or higher than the upper-limit setting value, and in the control step, an ON signal for opening the valve being outputted to the valve, in a case where the physical quantity outputted in the output step changes from a value higher than the lower-limit setting value to a value equal or lower than the lower-limit setting value.

Advantageous Effects of Invention

According to the present invention, it is possible to improve the removing efficiency effectively.

DESCRIPTION OF EMBODIMENTS

Figure 1:
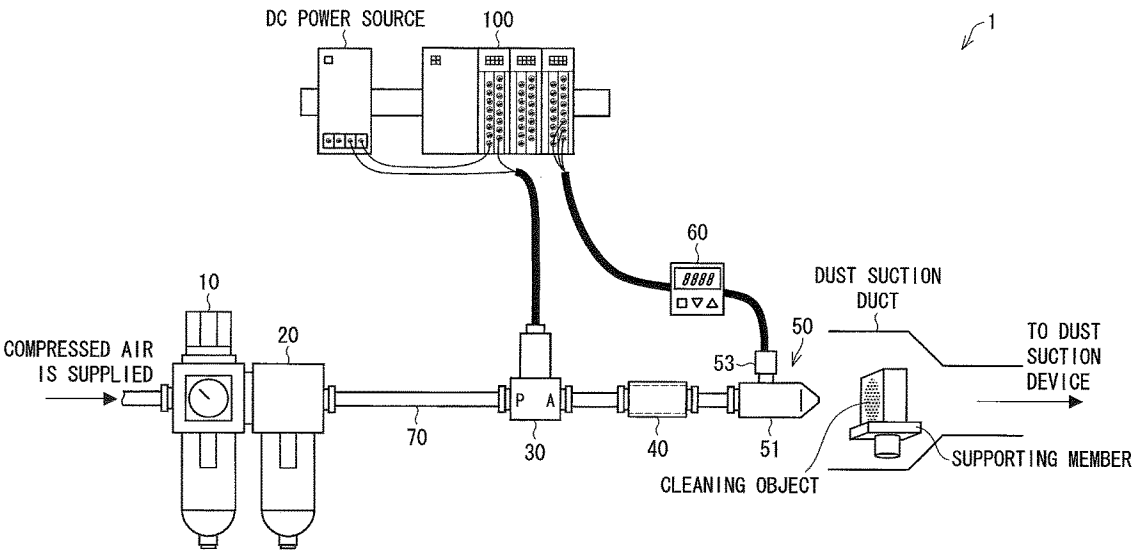
FIG. 1 is a view showing an example of an air-flushing device in accordance with an embodiment of the present invention.

The following describes an embodiment of the present invention with reference to the drawings. Note that, hereinafter, members having identical functions and names are given respective identical reference numerals, and a detailed description of those members will not be repeated.

Figure 2:
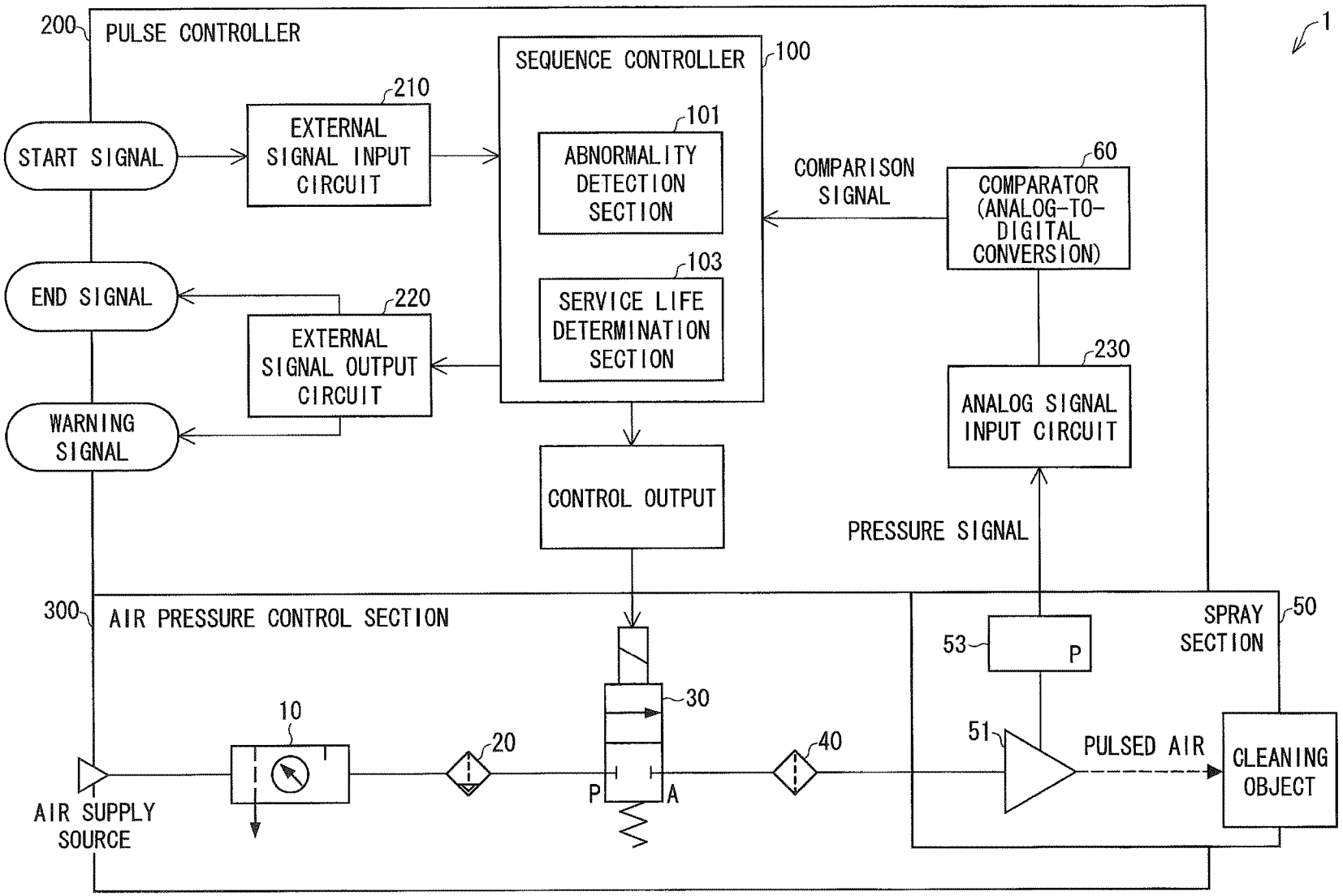
FIG. 2 is a functional block diagram showing the example of the air-flushing device in accordance with the embodiment of the present invention.

FIG. 1 is a view showing an example of an air-flushing device in accordance with an embodiment of the present invention. FIG. 2 is a functional block diagram showing the example of the air-flushing device in accordance with the embodiment of the present invention. The air-flushing device removes dust and/or the like by blowing pulsed air to a cleaning object that is held at a predetermined height by a supporting member. The dust removed by the air-flushing device from the cleaning object is collected into a dust suction device through a dust suction duct.

As illustrated in FIG. 1 and FIG. 2, the air-flushing device 1 includes a sequence controller (controller) 100, a regulator (pressure reducing valve with a filter) 10, a mist filter 20, an electromagnetic valve 30, an in-line filter 40, a spray unit (spray section) 50, and a two-position pressure switch (comparator) 60. The mist filter 20, the electromagnetic valve 30, the in-line filter 40, and the spray unit 50 are connected one another via an air pipe 70. The sequence controller 100 and the comparator 60 constitute a pulse controller 200. The regulator 10, the mist filter 20, the electromagnetic valve 30, and the in-line filter 40 constitute an air pressure control section 300.

The regulator 10 adjusts a pressure of compressed air supplied from an air supply section (not shown) into a predetermined pressure, and then provides the air thus adjusted to the mist filter 20. The mist filter 20 removes mist from the air supplied from the regulator 10.

The electromagnetic valve 30 is interposed between the mist filter 20 and the in-line filter 40, and opening and closing of the electromagnetic valve 30 are controlled by the sequence controller 40. The in-line filter 40 collects and removes foreign substances contained in the air.

The spray unit 50 blows pulsed air to a cleaning object with use of the air passed through the regulator 10, the mist filter 20, the electromagnetic valve 30, and the in-line filter 40. The following describes a configuration of the spray unit 50 with reference to the drawings.

Figure 3:
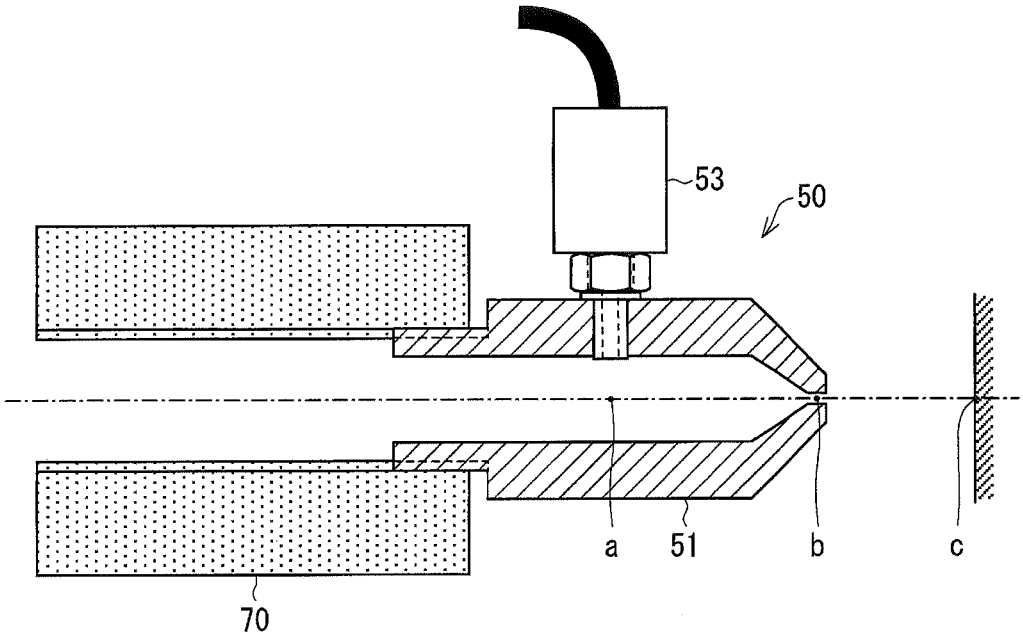
FIG. 3 is a first view showing an example of a spray unit.

FIG. 3 is a view showing an example of the spray unit. As illustrated in FIG. 3, the spray unit 50 includes a nozzle 51 and a pulse detection section (detection section) 53. The nozzle 51 is shaped in a cylinder having a tapered end whose diameter decreases toward the tip having a small hole. The air is discharged from the hole of the nozzle 51.

The pulse detection section 53 is, for example, a pressure sensor, and is provided in the nozzle 51. Specifically, the cylinder part of the nozzle 51 has a side surface having an opening that communicates with an air flow path, and the pulse detection section 53 is embedded into the opening from the outside of the cylinder part. Accordingly, the pulse detection section 53 can detect a pressure inside the nozzle 51 (i.e., a pressure indicated as a difference between the pressure inside the nozzle 51 and the atmospheric pressure). A pressure signal including the pressure value thus detected is outputted from the pulse detection section 53 to the comparator 60 via an analog signal input circuit 230.

Figure 4:
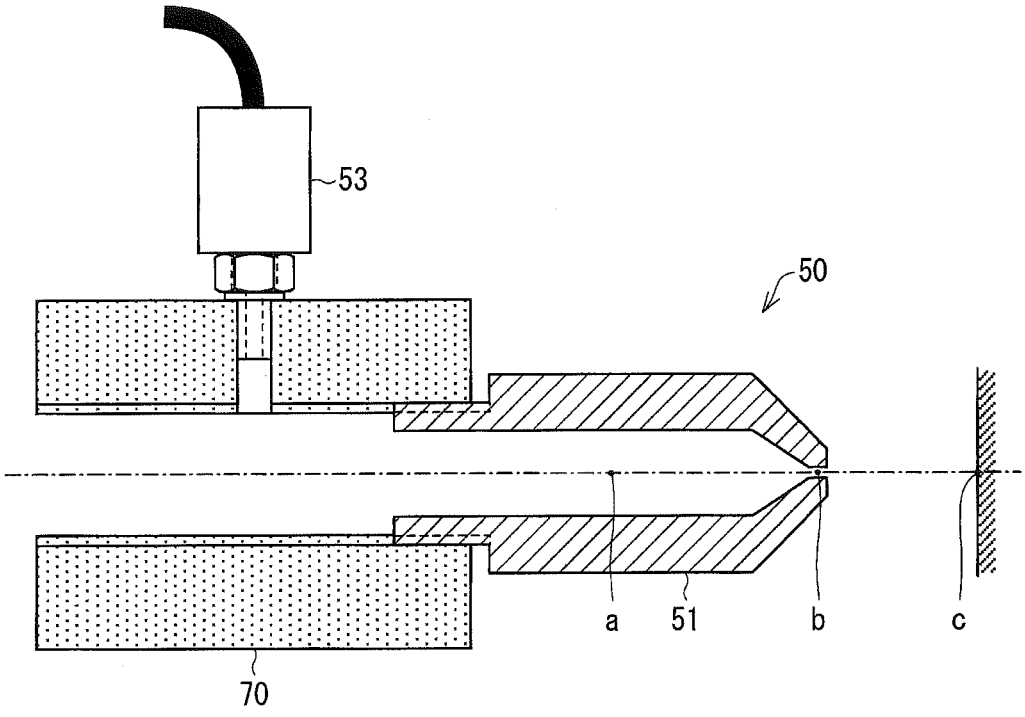
FIG. 4 is a second view showing an example of the spray unit.

Note that the description has been made so far by taking the example where the pulse detection section 53 is provided in the nozzle 51, however, the present invention is not limited to this. Alternatively, for example, as illustrated in FIG. 4, an opening that communicates with the air flow path may be provided in a part of the air pipe 70 which part is in the vicinity of the nozzle 51, and the pulse detection section 53 may be embedded into the opening from the outside of the air pipe 70.

The comparator 60 compares the pressure value detected by the pulse detection section 53 with predetermined upper-limit and lower-limit setting values. The upper-limit value is preferably around a pressure of the air supplied from the regulator 10 (hereinafter, such a pressure is referred to as "maximum pressure"), for example, in a range of 0.1 to 0.2 MPa. The lower-limit setting value is preferably around 0 MPa, which is the minimum pressure inside the nozzle 51, for example, in a range of 0.01 to 0.02 MPa.

If the pressure value detected by the pulse detection section 53 changes from a value less than the upper-limit setting value to a value equal to or higher than the upper-limit setting value, the comparator 60 outputs a first comparison signal indicative of the change to the sequence controller 100. If the pressure value detected by the pulse detection section 53 changes from a value higher than the lower-limit setting value to a value equal to or lower than the lower-limit setting value, the comparator 60 outputs a second comparison signal indicative of the change to the sequence controller 100.

The sequence controller 100 controls opening and closing of the electromagnetic valve 30 based on the signal from the comparator 60. Upon receipt of the first comparison signal from the comparator 60, the sequence controller 100 outputs an OFF signal to the electromagnetic valve 30 so as to close the electromagnetic valve 30. As a result, a flow path between the regulator 10 and the nozzle 51 is closed.

Upon receipt of the second signal from the comparator 60, the sequence controller 100 outputs an ON signal to the electromagnetic valve 30 so as to open the electromagnetic valve 30. As a result, the flow path between the regulator 10 and the nozzle 51 is established.

In the case where the electromagnetic valve 30 is opened in response to the instruction from the sequence controller 100, the air is supplied to the spray unit 50 and thus the pressure inside the nozzle 51 increases rapidly toward the maximum pressure. This allows the spray unit to instantly discharge the air of a strong pressure. Meanwhile, in the case where the electromagnetic valve 30 is closed in response to the instruction from the sequence controller 100, air supply to the spray unit 50 stops and thus the pressure inside the nozzle 51 decreases rapidly toward the minimum pressure. This allows the spray unit 50 to instantly stop blowing the air. Thus, by repeatedly opening and closing the electromagnetic valve 30 in response to the instructions from the sequence controller 100, it is possible to blow the air intermittently.

Figure 5:
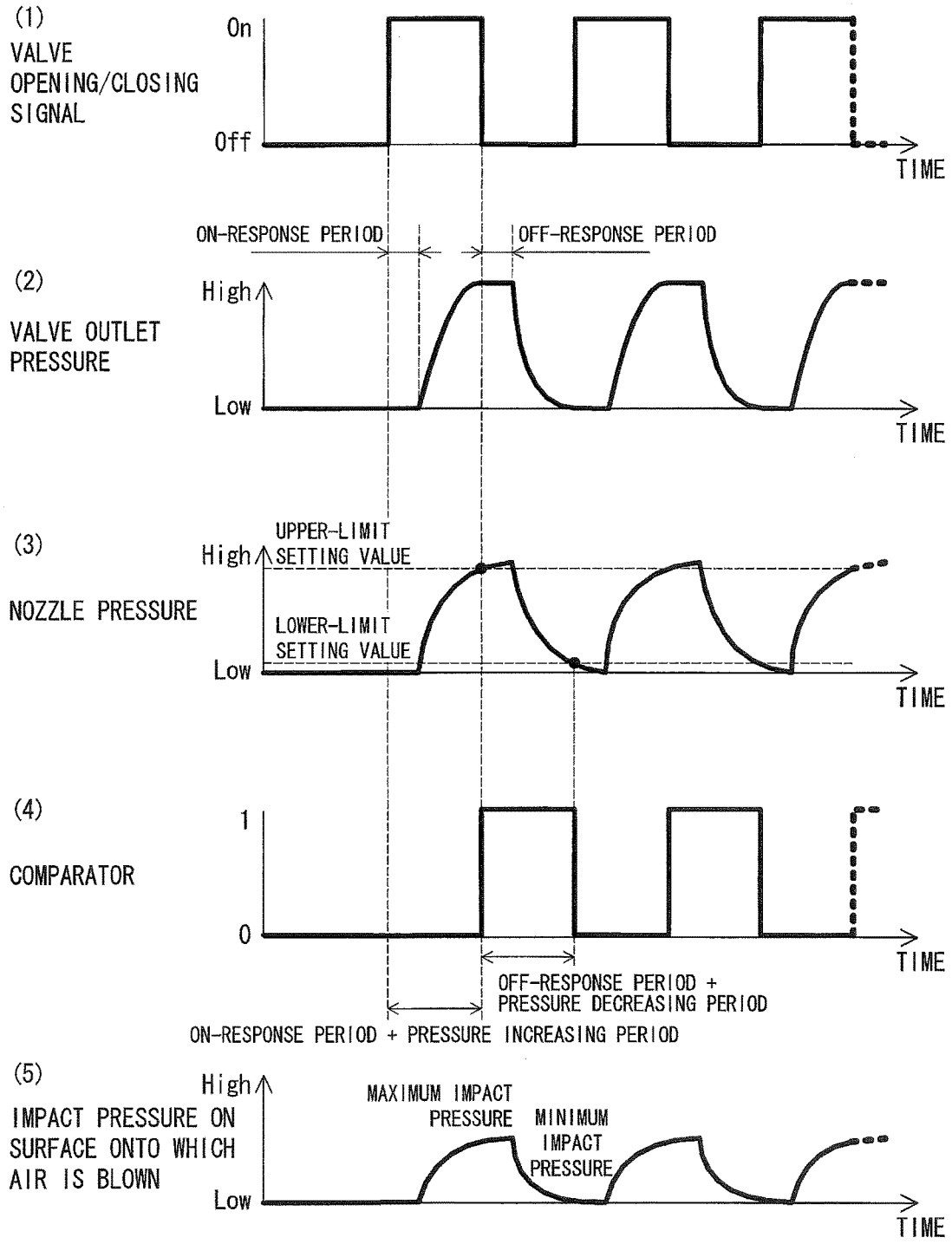
FIG. 5 shows operation charts of the air-flushing device.

FIG. 5 shows operation charts of the air-flushing device. In a case where an ON-signal is inputted to the electromagnetic valve 30 from the sequence controller 100 (a value opening/closing signal: ON), (i) a pressure in an outlet of the electromagnetic valve 30 (value outlet pressure), (ii) a pressure inside the nozzle 51 (nozzle pressure), and (iii) an impact pressure at which the air is blown to a surface of the cleaning object by the spray unit 50 (hereinafter, such a pressure is simply referred to as "impact pressure") begin to increase after an ON-response period has elapsed. The ON-response period refers to a delay period elapsed until the electromagnetic valve 30 is opened after the electromagnetic valve 30 receives the ON-signal.

After the ON-response period has elapsed, the pressure inside the nozzle 51 and the impact pressure (the impact pressure on the surface onto which the air is blown) increase, as the air is supplied into the nozzle 51. Then, after a pressure increasing period has elapsed, the pressure inside the nozzle 51 reaches the upper-limit value. When the comparator 60 detects that the pressure inside the nozzle 51 reaches the upper-limit value (an output from the comparator 60: 1), the sequence controller 100 inputs an OFF-signal to the electromagnetic valve 30 (the value opening/closing signal: OFF). The pressure increasing period refers to a period required until the air passes through the electromagnetic valve 30 and the flow path between the electromagnetic valve 30 and the nozzle 51 is filled up with the air.

In a case where the OFF-signal is inputted to the electromagnetic valve 30 (the value opening/closing signal: OFF), the pressure in the outlet of the electromagnetic valve 30, the pressure inside the nozzle 51, and the impact pressure begin to decrease after an OFF-response period has elapsed. The OFF-response period refers to a delay period elapsed until the electromagnetic valve 30 is closed after the OFF signal is inputted to the electromagnetic valve 30. Because of the existence of the OFF-response period, the pressure inside the nozzle 51 continues to increase until the electromagnetic valve 30 is closed after the OFF signal is inputted to the electromagnetic valve 30, so that the pressure inside the nozzle 51 exceeds the upper-limit value and reaches the maximum value. Further, as the pressure inside the nozzle 51 increases, the impact pressure also increases, so as to reach the maximum pressure.

After the OFF-response period has elapsed, the pressure inside the nozzle 51 and the impact pressure decrease, as the air is released from the nozzle 51. Then, after a pressure decreasing period has elapsed, the pressure inside the nozzle 51 reaches the lower-limit value. When the comparator 60 detects that the pressure inside the nozzle 51 reaches the lower-limit value (an output from the comparator: 0), the sequence controller 100 inputs the ON signal to the electromagnetic valve 30.

The pressure decreasing period refers to a period require for the air in the flow path between the electromagnetic valve 30 and the nozzle 51 to be completely discharged from the nozzle 51. Because of the existence of the pressure decreasing period, the pressure inside the nozzle 51 continues to decrease until the electromagnetic valve 30 is opened after the ON signal is inputted to the electromagnetic valve 30, so that the pressure inside the nozzle 51 becomes lower than the lower-limit value and reaches the minimum pressure of 0 (MPa). Further, as the pressure inside the nozzle 51 decreases, the impact pressure decreases, so as to reach the minimum pressure of 0 (MPa).

Note that the ON-response period and the OFF-response period are specific to the electromagnetic valve, and vary depending on the type of the electromagnetic valve, the individual electromagnetic valve, and an operation voltage of the electromagnetic valve.

Figure 7:
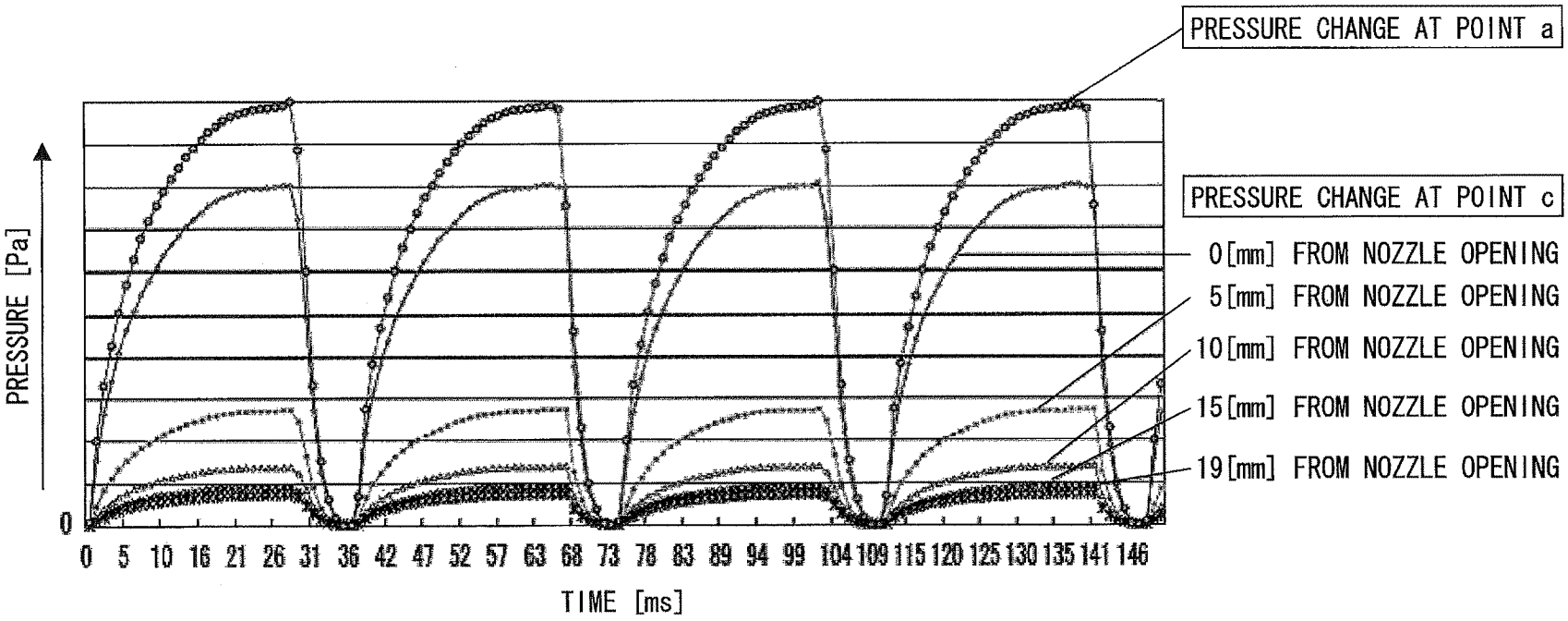
FIG. 7 shows changes over time in (i) pressures in the nozzle and (ii) impact pressures.

According to the above description, after the electromagnetic valve 30 is opened, the impact pressure increases to reach the maximum pressure as the pressure inside the nozzle 51 increases. Meanwhile, after the electromagnetic valve 30 is closed, the impact pressure decreases to reach the minimum pressure of 0 (MPa) as the pressure inside the nozzle 51 decreases. These have been for the first time proven by the inventors of the present invention by the experimental data of FIG. 7, which shows that (i) the increase of the pressure inside the nozzle 51 and the increase of the impact pressure are in sync with each other and (ii) the decrease of the pressure inside the nozzle 51 and the decrease of the impact pressure are in sync with each other.

As described earlier, opening and closing of the electromagnetic valve 30 are controlled in consideration of the ON-response period, the pressure increasing period, the-OFF response period, and the pressure decreasing period. Namely, by outputting the ON signal to the electromagnetic valve 30 when the pressure inside the nozzle 51 is at the lower-limit setting value before the pressure inside the nozzle 51 reaches the minimum pressure, it is possible to open the electromagnetic valve 30 when the pressure inside the nozzle 51 reaches the minimum pressure. In other words, the period required for the pressure inside the nozzle 51 to change from the lower-limit setting value to the minimum pressure is made coincide with the ON-response period, thereby making it possible for the pressure inside the nozzle 51 to increase immediately after the pressure inside the nozzle 51 reaches the minimum pressure.

Meanwhile, by outputting the OFF signal to the electromagnetic valve 30 when the pressure inside the nozzle 51 is at the upper-limit setting value before the pressure inside the nozzle 51 reaches the maximum pressure, it is possible to close the electromagnetic valve 30 when the pressure inside the nozzle 51 reaches the maximum pressure. In other words, the period require for the pressure inside the nozzle 51 to change from the upper-limit setting value to the maximum pressure is made coincide with the OFF-response period, thereby making it possible for the pressure inside the nozzle 51 to decrease immediately after the pressure inside the nozzle 51 reaches the maximum pressure.

As a result, it is possible to carry out the air blowing intermittently at shortest intervals with use of the maximum pressure and the minimum pressure. In a conventional configuration for setting an optimum frequency of opening and closing of the valve with use of a timer or the like, it is necessary to consider (i) the period including the ON-response period and the pressure increasing period and (ii) the period including the OFF-response period and the pressure decreasing period. However, it is difficult to appreciate these periods and set the optimum frequency of opening and closing of the valve. On the other hand, according to the air-flushing device 1 of the present embodiment, the pulse detection section 53 detects, in the nozzle 51, (i) a pressure indicated by the upper-limit setting value, which is around the maximum pressure, and (ii) a pressure indicated by the lower-limit setting value, which is around the minimum pressure. Further, based on these pressures thus detected, the air-flushing device 1 of the present embodiment controls opening and closing of the electromagnetic valve 30, and thus does not require the setting for the frequency of opening and closing of the electromagnetic valve 30.

With reference to FIG. 1 and FIG. 2 again, the sequence controller 100 includes (i) an abnormality detection section 101 for detecting an abnormality of the air-flushing device 1 during the cleaning and (ii) a service life determination section 103 for determining a service life of the electromagnetic valve 30.

The abnormality detection section 101 checks for an abnormality from start to end of the cleaning. When the air-flushing device 1 confirms that a cleaning object is located in a predetermined position in the supporting member, the air-flushing device 1 starts blowing of pulsed air. When the number of times at which pulsed air is blown reaches a setting number of times of blowing, the air-flushing device 1 ends the cleaning. Specifically, a sensor or the like is provided that monitors the predetermined position in the supporting member. When the sensor detects the cleaning object, a start signal is inputted via an external signal input circuit 210. In response to the start signal, cleaning is started. Meanwhile, when the cleaning ends, an end signal is outputted via an external signal output circuit 220.

The number of times at which pulsed air is blown is, for example, the number of counting, as pulses, the changes in the pressure outputted by the pulse detection section 53. In a case where the pulse detection section 53 detects a pressure at the upper-limit setting value and then detects a pressure at the lower-limit setting value, the abnormality detection section 101 counts it as one(1) pulse. Counting of the number of times at which pulsed air is blown starts when the cleaning starts, and is initialized when the cleaning ends.

In a case where the cleaning does not end within a setting end period after the cleaning is started, the abnormal detection section 101 determines it as an abnormality. Further, in each of (i) a case where the comparator 60 does not detect the upper-limit setting value within a first setting detection period after the ON signal is supplied to the electromagnetic valve 30 and (ii) a case where the comparator 60 does not detect the lower-limit setting value within a second setting detection period after the OFF signal is supplied to the electromagnetic valve 30, the abnormal detection section 101 determines it as an abnormality. In the case where the abnormality detection section 101 determines that there is an abnormality in the cleaning, the abnormality detection section 101 outputs a warning signal via the external signal output circuit 220. For example, at the point when the abnormality detection section 101 determines that there is an abnormality, the cleaning is ended. This makes it possible to prevent imperfect air blowing caused by poor opening and closing of the electromagnetic valve 30 or by clogging in the flow path extending to the nozzle 51.

The service life determination section 103 determines a service life of the electromagnetic valve 30 on the basis of (i) the actual number of times of opening and closing the electromagnetic valve 30 and (ii) the setting number of times of opening and closing the electromagnetic valve 30 according to the service life (i.e., the setting number of times according to the service life). The actual number of times of opening and closing the electromagnetic valve 30 is calculated by, for example, totalizing the number of times at which pulsed air is blown. If the actual number of times of opening and closing reaches the setting number of times according to the service life, the service life determination section 103 determines that the service life of the electromagnetic valve 30 is exhausted, and outputs a signal for promoting an inspection or exchange. For example, the sequence controller 100 may display a warning on its display screen. This makes it possible to prevent poor opening and closing of the electromagnetic valve 30. Note that the actual number of times of opening and closing the electromagnetic valve 30 is initialized when it is determined that an inspection or exchange has been carried out.

Figure 6:
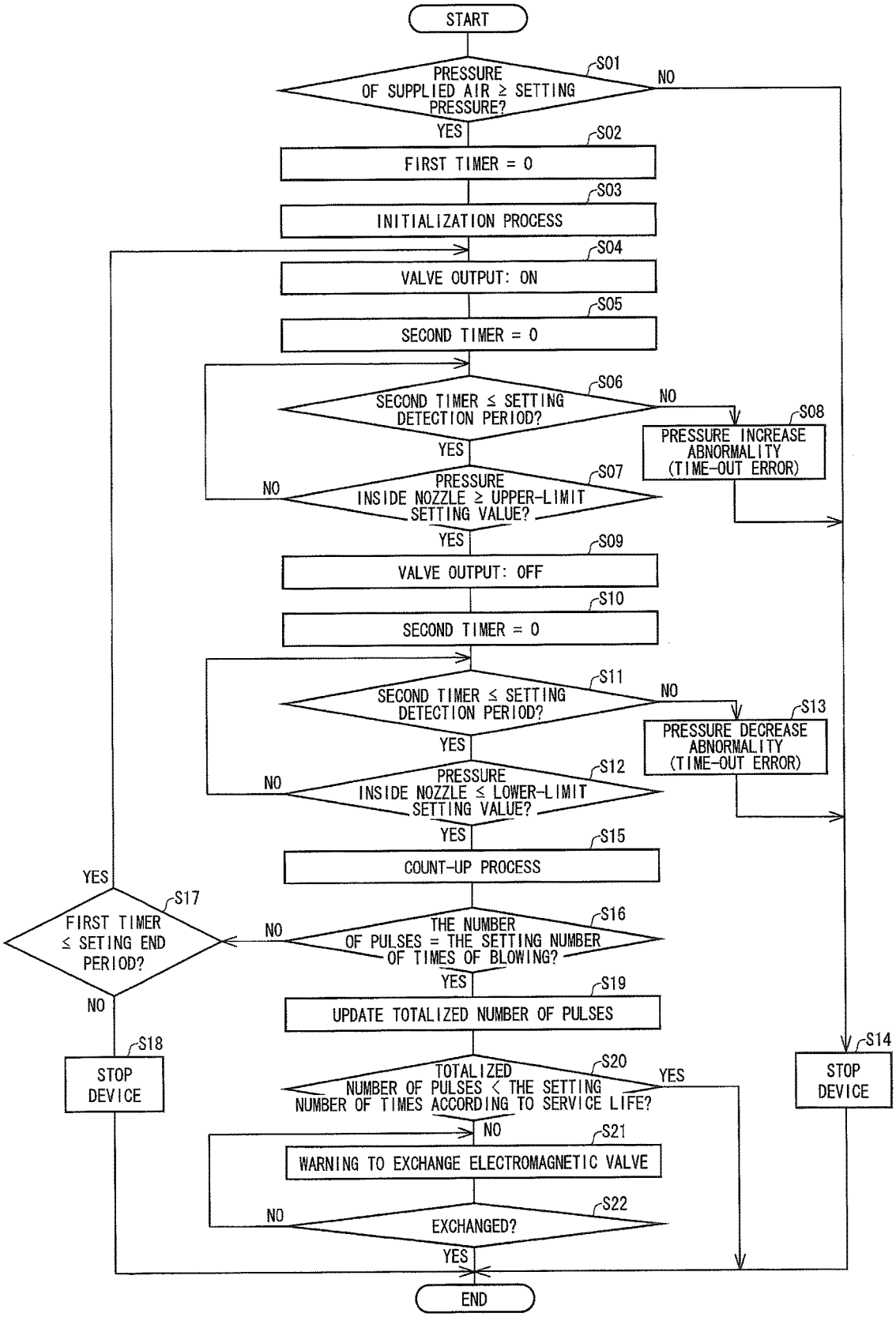
FIG. 6 is a flow chart showing an example of a pulsed air control process.

FIG. 6 is a flow chart showing an example of a pulsed air control process. The pulsed air control process is carried out as a result of execution of a pulsed air control program by the sequence controller 100.

As illustrated in FIG. 6, after cleaning is started, the sequence controller 100 determines whether or not a pressure of the air supplied from the air supply section is equal to or higher than a setting pressure (Step S01). If the pressure is equal to or higher than the setting pressure, the process goes to Step S02. Meanwhile, if the pressure is not equal to or higher than the setting pressure, the process goes to Step S14. The air-flushing device 1 is provided with a sensor or the like for monitoring the predetermined position in the supporting member. If the sensor detects a cleaning object, a start signal is inputted. In response to the start signal, the cleaning is started.

In Step S02, the sequence controller 100 sets a value of a first timer at "0". The first timer measures a period elapsed from the start of the cleaning in Step S01.

In the next Step S03, the sequence controller 100 executes an initialization process, and the process goes to Step S04. By the initialization process, the number of times at which pulsed air is blown (the number of pulses) is set at "0", and the actual number of times of opening and closing the electromagnetic valve 30 (a totalized number of pulses) is set at a value in the process previously carried out.

In Step S04, the sequence controller 100 outputs the ON signal to the electromagnetic valve 30, so as to open the electromagnetic valve 30. Then, the sequence controller 100 sets a value of a second timer at "0" (Step S05). The second timer in Step S05 measures a period elapsed from the outputting of the ON signal to the electromagnetic valve 30 in Step S04.

In the next Step S06, the sequence controller 100 determines whether or not the period measured by the second timer in Step S05 reaches the first setting detection period. If the period measured by the second timer in Step S05 is equal to or shorter than the first setting detection period, the process goes to Step S07. Meanwhile, if the period measured by the second timer in Step S05 is not equal to or shorter than the first setting detection period, the process goes to Step S08.

In Step S07, the sequence controller 100 determines whether or not the pressure inside the nozzle 51 is equal to or higher than the upper-limit setting value. Specifically, if the sequence controller 100 receives a first comparison signal from the comparator 60, the sequence controller 100 determines that the pressure inside the nozzle 51 is equal to or higher than the upper-limit setting value. If the pressure inside the nozzle 51 is equal to or higher than the upper-limit setting value, the sequence controller 100 advances the process to Step S09. Meanwhile, if the pressure inside the nozzle 51 is not equal to or higher than the upper-limit setting value, the sequence controller 100 returns the process to Step S06.

In Step 08, the sequence controller 100 determines that there is an abnormality in the pressure increase, and advances the process to Step S14.

In Step S09, the sequence controller 100 outputs the OFF signal to the electromagnetic valve 30, so as to close the electromagnetic valve 30. Then, the sequence controller 100 sets the value of the second timer at "0" (Step S10). In Step S10, the second timer measures a period elapsed from the outputting of the OFF signal to the electromagnetic valve 30 in Step S09.

In the next Step S11, the sequence controller 100 determines whether or not the period measured by the second timer in Step S10 is equal to or shorter than the second setting detection period. If the period measured by the second timer in Step S10 is equal to or shorter than the second setting detection period, the process is advanced to Step S12. Meanwhile, if the period measured by the second timer in Step S10 is not equal to or shorter than the second setting detection period, the process is advanced to Step S13.

In Step S12, the sequence controller 100 determines whether or not the pressure inside the nozzle 51 is equal to or lower than the lower-limit setting value. Specifically, if the sequence controller 100 receives a second comparison signal from the comparator 60, the sequence controller 100 determines that the pressure inside the nozzle 51 is equal to or lower than the lower-limit setting value. If the pressure inside the nozzle 51 is equal to or lower than the lower-limit setting value, the sequence controller 100 advances the process to Step S15. Meanwhile, if the pressure inside the nozzle 51 is not equal to or lower than the lower-limit setting value, the sequence controller 100 returns the process to Step S11.

In Step S13, the sequence controller 100 determines that there is an abnormality in the pressure decrease, and advances the process to Step S14. In Step S14, the sequence controller 100 stops the whole air-flushing device 1, so as to end the pulsed air control process.

In Step S15, the sequence controller 100 executes a count-up process for counting the number of pulses. Specifically, the pressure inside the nozzle 51 reaches a value equal to or higher than the upper-limit setting value in Step S07, and then reaches a value equal to or lower than the lower-limit setting value in Step S12. This change is counted as one (1) pulse.

In the next Step S16, the sequence controller 100 determines whether or not the number of pulses counted in Step S15 reaches a setting number of times of blowing. If the number of pulses counted in Step S15 reaches the setting number of times of blowing, the process is advanced to Step S19. Meanwhile, if the number of pulses counted in Step S15 does not reach the setting number of times of blowing, the process is advanced to Step S17. If the number of pulses counted in Step S15 reaches the setting number of times of blowing, the cleaning is ended.

In Step S17, the sequence controller 100 determines whether or not the period measured by the first timer in Step S02 is equal to or shorter than a setting end period. In other words, the sequence controller 100 determines whether or not the cleaning is ended within the setting end period. If the period measured by the first timer in Step S02 is equal to or shorter than the setting end period, the process is returned to Step S04. Meanwhile, if the period measured by the first timer in Step S02 is not equal to or shorter than the setting end period, the process is advanced to Step S18.

In Step S18, the sequence controller 100 stops the whole air-flushing device 1, so as to end the pulsed air control process.

In Step S19, the sequence controller 100 updates the totalized number of pulses. Specifically, in order to obtain the totalized number of pulses, the sequence controller 100 adds (i) the number of pulses which has reached the setting number of times of blowing in Step S16 to (ii) the number of pulses in the process previously carried out.

In the next Step S20, the sequence controller 100 determines whether or not the totalized number of pulses updated in Step S19 is less than the setting number of times according to the service life. If the totalized number of pulses updated in Step S19 is less than the setting number of times according to the service life, the pulsed air control processing is ended. Meanwhile, if the totalized number of pulses updated in Step S19 is not less than the setting number of times to the service life, the process is advanced to Step S21.

In Step S21, the sequence controller 100 executes an electromagnetic valve exchange warning process, and advances the process to Step S22. The electromagnetic valve exchange warning process is a process for outputting a signal that promotes an inspection or exchange.

In Step S22, the sequence controller 100 determines whether or not the electromagnetic valve 30 has been exchanged. If the electromagnetic valve 30 has been exchanged, the pulsed air control process is ended. If the electromagnetic valve 30 has not been exchanged, the process is returned to Step S21.

Note that, as has been described earlier, the air-flushing device 1 in accordance with the embodiment of the present invention is a device for cleaning a cleaning object by blowing the air to the cleaning object from a nozzle, including: an electromagnetic valve 30, provided in a flow path through which the air goes to the nozzle 51, for opening and closing the flow path; a pulse detection section 53 for outputting a pressure value changing in accordance with opening and closing of the electromagnetic valve 30; a sequence controller 100 for controlling opening and closing of the electromagnetic valve 30 in accordance with two reference values of an upper-limit setting value and a lower-limit setting value which is lower than the upper-limit setting value, the sequence controller 100 closing the electromagnetic valve 30, in a case where the pressure value outputted by the pulse detection section 53 changes from a value lower than the upper-limit setting value to a value equal to or higher than the upper-limit setting value, and the sequence controller 100 opening the electromagnetic valve 30, in a case where the pressure value outputted by the pulse detection section 53 changes from a value higher than the lower-limit setting value to a value equal to or lower than the lower-limit setting value.

According to the above configuration, in a case where the electromagnetic valve 30 is open, the pressure inside the nozzle increases toward a maximum pressure as the amount of the air supplied to the nozzle increases. Therefore, it is possible to switch the electromagnetic valve from the open state to the closed state when the pressure inside the nozzle reaches a value corresponding to the upper-limit setting value.

In a case where the electromagnetic valve is closed, the pressure inside the nozzle decreases toward a minimum pressure as the amount of the air in the nozzle decreases. Therefore, it is possible to switch the electromagnetic valve from the closed state to the open state when the pressure inside the nozzle reaches a value corresponding to the lower-limit setting value.

Furthermore, for the electromagnetic valve, there exist (i) a delay period elapsed until the electromagnetic valve is opened after the electromagnetic valve receives the ON signal and (ii) a delay period elapsed until the electromagnetic valve is closed after the electromagnetic valve receives the OFF signal. The above configuration takes advantage of these delay periods. Therefore, even if the electromagnetic valve 30 is switched from the open state to the closed state before the maximum pressure is attained, it is possible to blow the air with a pressure higher than a pressure corresponding to the upper-limit setting value. Likewise, even if the electromagnetic valve 30 is switched from the closed state to the open state before the minimum pressure is attained, it is possible to blow the air with a pressure lower than a pressure corresponding to the lower-limit setting value. Therefore, the above configuration makes it possible to blow the air with use of the maximum pressure and the minimum pressure as the working pressure.

In addition, according to the configuration described earlier, the electromagnetic valve 30 is switched from the open state to the closed state before the maximum pressure is attained, and the electromagnetic valve 30 is switched from the closed state to the open state before the minimum pressure is attained. This makes it possible to carry out the air blowing intermittently at shorter intervals.

Thus, it is possible to provide an air-flushing device which is able to improve the removing efficiency effectively.

Note that the description in the present embodiment has been made by taking the example where the nozzle 51 is provided with the pressure sensor serving as the pulse detection section 53, however, the present invention is not limited to this. The pulse detection section 53 may be any sensor, as long as it is able to output a physical quantity relating to the air and changing in accordance with opening and closing of the electromagnetic valve 30. Instead of the pressure sensor, a flow rate sensor or an air velocity sensor may be used. Further, instead of the pressure sensor, a temperature sensor may be used. In a case where the temperature sensor is used instead of the pressure sensor, a heat source is provided inside the nozzle 51, and the temperature sensor detects a change in temperature of the heat source which change is caused by a fluid inside the nozzle 51.

Instead of the pressure sensor, an ejection detection sensor may be used to detect a change in temperature (infrared ray) of the cleaning object. In a case where the ejection detection sensor is used, the change in temperature detected via an infrared ray may be used to control an irradiation range. Further, instead of the electromagnetic valve 30, an air controlled valve may be used. In this case, part of the pressure inside the nozzle 51 is loopback to a pilot signal of the air controlled valve, so that the valve is configured to be self-excited.

Embodiment by Software

Control blocks (particularly, the sequence controller 100 and the pulse controller 200) of the air-flushing device 1 may be realized by a logical circuit (hardware) on an integrated circuit (IC chip) or the like, or may be realized by software as executed by a CPU (Central Processing Unit).

In a case where the control block is realized by software, the air-flushing device 1 includes a CPU, a ROM (read only memory) or a storage device (hereinafter, these are referred to as "storage media"), and a RAM (random access memory). The CPU executes instructions in programs, which constitute software realizing the functions. The storage medium contains the programs and various data in a computer-readable manner or a CPU-readable manner. To the RAM, the programs are loaded, The object of the present invention can also be achieved in such a manner that the computer (or the CPU) retrieves and executes the programs contained in the storage medium. The storage medium may be a "non-transitory tangible medium", examples of which encompass tapes, discs, cards, semiconductor memories, and programmable logic circuits. Further, the programs may be delivered to the computer over any transmission medium (e.g., a communications network or a broadcast wave) which is able to transmit the programs. The present invention encompasses data signals which are embodied by electronic transmission of the programs and are embedded in a carrier wave

SUMMARY

As has been described earlier, an air-flushing method of the present invention is an air-flushing method for cleaning a cleaning object by blowing the air to the cleaning object from a nozzle, said method including: a control step of controlling, in accordance with two reference values, opening and closing of a valve provided in a flow path through which the air goes to the nozzle, the two reference values including an upper-limit setting value and a lower-limit setting value which is lower than the upper-limit setting value; and an output step of outputting a physical quantity relating to the air, the physical quantity changing in accordance with opening and closing of the valve, in the control step, an OFF signal for closing the valve being outputted to the valve, in a case where the physical quantity outputted in the output step changes from a value lower than the upper-limit setting value to a value equal to or higher than the upper-limit setting value, and in the control step, an ON signal for opening the valve being outputted to the valve, in a case where the physical quantity outputted in the output step changes from a value higher than the lower-limit setting value to a value equal or lower than the lower-limit setting value.

According to the above configuration, in a case where the valve is open, the air is supplied to the nozzle. Therefore, as the amount of the air supplied to the nozzle increases, the physical quantity outputted in the output step increases toward a maximum physical quantity. In other words, the physical quantity outputted in the output step increases along with the increase of the pressure inside the nozzle which increase is caused by the air supply to the nozzle. This makes it possible to switch the valve from the open state to the closed state when the pressure inside the nozzle reaches a value corresponding to the upper-limit setting value.

In a case where the valve is closed, the air is not supplied to the nozzle. Therefore, as the amount of the air in the nozzle decreases, the pressure of the air outputted in the output step decreases toward a minimum pressure. In other words, the physical quantity outputted in the output step decreases along with the decrease of the pressure inside the nozzle. This makes it possible to switch the valve from the closed state to the open state when the pressure inside the nozzle reaches a value corresponding to the lower-limit setting value.

Further, for the valve, there exist (i) a delay period elapsed until the valve is opened after the valve receives the ON signal and (ii) a delay period elapsed until the valve is closed after the valve receives the OFF signal. The above configuration takes advantage of these delay periods. Therefore, even if the valve is switched from the open state to the closed state before a maximum pressure corresponding to the maximum physical quantity is attained, it is possible to blow the air with a pressure higher than a pressure corresponding to the upper-limit setting value. Likewise, even if the valve is switched from the closed state to the open state before a minimum pressure corresponding to a minimum physical quantity is attained, it is possible to blow the air with a pressure lower than a pressure corresponding to the lower-limit setting value. Thus, by suitably adjusting the upper-limit setting value and the lower-limit setting value, it is possible to blow the air with use of the maximum pressure and the minimum pressure as a working pressure. Namely, it is possible to carry out the air blowing intermittently at shorter intervals.

Thus, it is possible to provide an air-flushing device which is able to improve the removing efficiency effectively.

The air-flushing method of the present invention further includes: an upper-limit setting value setting step of setting a candidate upper-limit setting value as the upper-limit setting value, in a case where (i) a period required for the physical quantity outputted in the output step to reach a maximum physical quantity from the candidate upper-limit setting value coincides with (ii) an OFF-response period elapsed until the valve is closed after the OFF signal is outputted to the valve in the control step; and a lower-limit setting value setting step of setting a candidate lower-limit setting value as the lower-limit setting value, in a case where (i) a period required for the physical quantity outputted in the output step to reach a minimum physical quantity from the candidate lower-limit setting value coincides with (ii) an ON-response period elapsed until the valve is opened after the ON signal is outputted to the valve in the control step.

According to the above configuration, it is possible to switch the valve from the open state to the closed state immediately after the maximum pressure corresponding to the maximum physical quantity is attained, and it is also possible to switch the valve from the closed state to the open state after the minimum pressure corresponding to the minimum physical quantity is attained. Thus, it is possible to carry out the air blowing intermittently at shorter intervals.

The air-flushing method of the present invention further includes: a first abnormality detection step of detecting an abnormality in the cleaning, wherein in the first abnormality detection step, it is determined that there is an abnormality and the cleaning is stopped, in a case where the physical quantity outputted in the output step is less than the upper-limit setting value when a first setting detection period has elapsed after the ON signal for opening the valve is outputted to the valve, and in the first abnormality detection step, it is determined that there is an abnormality and the cleaning is stopped, in a case where the physical quantity outputted in the output step is higher than the lower-limit setting value when a second setting detection period has elapsed after the OFF signal for closing the valve is outputted to the valve.

The air-flushing method of the present invention further includes: a second abnormality detecting step of detecting an abnormality in the cleaning, wherein in the second abnormality detecting step, it is determined that there is an abnormality and the cleaning is stopped, in a case where the cleaning does not end within a setting end period after the cleaning is started.

According to the above configuration, it is possible to prevent imperfect air blowing caused by poor opening and closing of the valve or by clogging in the flow path extending to the nozzle.

The air-flushing method of the present invention further includes: a service life determination step of determining a service life of the valve; and a counting step of counting, as a pulse, a change in the physical quantity outputted in the output step, wherein in the service life determination step, a notification of an inspection and exchange of the valve is issued, in a case where it is determined that a totalized number of pulses reaches a setting number of times according to the service life, the integrated number of pulses being obtained by totalizing the number of pulses counted in the counting step.

According to the above configuration, it is possible to prevent poor opening and closing of the valve.

The air-flushing method of the present invention is configured such that the physical quantity outputted in the output step is a value of pressure inside the nozzle; the upper-limit setting value is around a maximum pressure; and the lower-limit setting value is around a minimum pressure of 0 MPa.

According to the above configuration, it is possible to realize blowing of perfect pulsed air with use of the minimum pressure of 0 (MPa) as the working pressure.

Preferably, the air-flushing method of the present invention is configured such that the valve is an electromagnetic valve.

In order to solve the problems described earlier, the air-flushing device of the present invention is an air-flushing device for cleaning a cleaning object by blowing the air to the cleaning object from a nozzle, including: a valve, provided in a flow path through which the air goes to the nozzle, for opening and closing the flow path; a detection section for outputting a physical quantity relating to the air, the physical quantity changing in accordance with opening and closing of the valve; a controller for controlling opening and closing of the valve in accordance with two reference values of an upper-limit setting value and a lower-limit setting value which is lower than the upper-limit setting value, the controller closing the valve, in a case where the physical quantity outputted by the detection section changes from a value lower than the upper-limit setting value to a value equal to or higher than the upper-limit setting value, and the controller opening the valve, in a case where the physical quantity outputted by the detection section changes from a value higher than the lower-limit setting value to a value equal to or lower than the lower-limit setting value.

According to the above configuration, it is possible to provide an air-flushing device which is able to improve the removing efficiency effectively.

Furthermore, the air-flushing device of the present invention is configured such that the detection section includes a pressure sensor, and the detection section outputs, as the physical quantity, (i) a pressure in a part of the flow path which part is in the nozzle or (ii) a pressure in a part of the flow path which part is in the vicinity of the nozzle.

An air-flushing device in accordance with each embodiment of the present invention may be realized by a computer. In such a case, the present invention encompasses (i) an air-flushing program for causing a computer to function as the above air-flushing device by causing the computer to operate as each section of the air-flushing device and (ii) a computer-readable storage medium in which the air-flushing program is stored.

The present invention is not limited to the description of the embodiments above, but may be altered by a skilled person within the scope of the claims. An embodiment based on a proper combination of technical means disclosed in different embodiments is encompassed in the technical scope of the present invention.

REFERENCE SIGNS LIST

1 Air-flushing device
10 Regulator

20 Mist filter
30 Electromagnetic valve
40 In-line filter
50 Spray unit
51 Nozzle
53 Pulse detection section (detection section)
60 Comparator
70 Air pipe
100 Sequence controller (controller)
101 Abnormality detection section
103 Service life determination section
200 Pulse controller
210 External signal input circuit
220 External signal output circuit
230 Analog signal input circuit
300 Air pressure control section

The invention claimed is:

1. An air-flushing method for cleaning a cleaning object by blowing the air to the cleaning object from a nozzle, said method comprising:

a control step of controlling, in accordance with two reference values, opening and closing of a valve provided in a flow path through which the air goes to the nozzle, the two reference values including an upper-limit setting value and a lower-limit setting value which is lower than the upper-limit setting value; and an output step of outputting a value indicative of a physical quantity relating to the air, the physical quantity changing in accordance with opening and closing of the valve, wherein in the control step, an OFF signal for closing the valve being outputted to the valve, in a case where the value indicative of the physical quantity outputted in the output step changes from a value lower than the upper-limit setting value to a value equal to or higher than the upper-limit setting value, and wherein in the control step, an ON signal for opening the valve being outputted to the valve, in a case where the value indicative of the physical quantity outputted in the output step changes from a value higher than the lower-limit setting value to a value equal or lower than the lower-limit setting value.

2. The air-flushing method as set forth in claim 1, further comprising:

an upper-limit setting step of setting a candidate upper-limit value as the upper-limit setting value, in a case where (i) a period required for the value indicative of the physical quantity outputted in the output step to reach a maximum physical quantity from the candidate upper-limit value coincides with (ii) an OFF-response period elapsed until the valve is closed after the OFF signal is outputted to the valve in the control step; and a lower-limit setting step of setting a candidate lower-limit value as the lower-limit setting value, in a case where (i) a period required for the value indicative of the physical quantity outputted in the output step to reach a minimum physical quantity from the candidate lower-limit value coincides with (ii) an ON-response period elapsed until the valve is opened after the ON signal is outputted to the valve in the control step.

3. The air-flushing method as set forth in claim 1, further comprising:

a first abnormality detection step of detecting an abnormality in the cleaning, the abnormality being an abnormality in opening and closing of the valve and/or an abnormality caused by clogging in the flow path, wherein in the first abnormality detection step, it is determined that there is an abnormality and the cleaning is stopped, in a case where the value indicative of the physical quantity outputted in the output step is less than the upper-limit setting value when a first setting detection period has elapsed after the ON signal for opening the valve is outputted to the valve, and wherein in the first abnormality detection step, it is determined that there is an abnormality and the cleaning is stopped, in a case where the value indicative of the physical quantity outputted in the output step is higher than the lower-limit setting value when a second setting detection period has elapsed after the OFF signal for closing the valve is outputted to the valve.

4. The air-flushing method as set forth in claim 1, further comprising:

a second abnormality detecting step of detecting an abnormality in the cleaning, the abnormality being an abnormality in opening and closing of the valve, wherein in the second abnormality detecting step, it is determined that there is an abnormality and the cleaning is stopped, in a case where the cleaning does not end within a setting end period after the cleaning is started.

5. The air-flushing method as set forth in claim 1, further comprising:

a service life determination step of determining a service life of the valve; and a counting step of counting, as a pulse, a change in the value indicative of the physical quantity outputted in the output step, wherein in the service life determination step, a notification of an inspection and exchange of the valve is issued, in a case where it is determined that a totalized number of pulses reaches a setting number of times according to the service life, the integrated number of pulses being obtained by totalizing the number of pulses counted in the counting step.

6. The air-flushing method as set forth in claim 1, wherein the value indicative of the physical quantity outputted in the output step is a value of pressure inside the nozzle, wherein the upper-limit setting value is around a maximum pressured, and wherein the lower-limit setting value is around a minimum pressure of 0 MPa.

7. The air-flushing method as set forth in claim 1, wherein the valve is an electromagnetic valve.

8. An air-flushing device for cleaning a cleaning object by blowing the air to the cleaning object from a nozzle, comprising:

a valve, provided in a flow path through which the air goes to the nozzle, for opening and closing the flow path;

a detection section for outputting a value indicative of a physical quantity relating to the air, the physical quantity changing in accordance with opening and closing of the valve;

a controller for controlling opening and closing of the valve in accordance with two reference values of an upper-limit setting value and a lower-limit setting value which is lower than the upper-limit setting value, the controller closing the valve, in a case where the value indicative of the physical quantity outputted by the detection section changes from a value lower than the upper-limit setting value to a value equal to or higher than the upper-limit setting value, and the controller opening the valve, in a case where the value indicative of the physical quantity outputted by the detection section changes from a value higher than the lower-limit setting value to a value equal to or lower than the lower-limit setting value.

9. The air-flushing device as set forth in claim 8, wherein the detection section includes a pressure sensor, and the detection section outputs, as the physical quantity, (i) a pressure in a part of the flow path which part is in the nozzle or (ii) a pressure in a part of the flow path which part is in the vicinity of the nozzle.

10. A computer-readable storage medium in which an air-flushing program for causing a computer to function as an air-flushing device as set forth in claim 8 is stored, the air-flushing program causing the computer to operate as each section.

* * * * *